US006788328B2

(12) United States Patent
Torisawa

(10) Patent No.: US 6,788,328 B2
(45) Date of Patent: Sep. 7, 2004

(54) HEAT DEVELOPMENT APPARATUS HAVING A TEMPERATURE ADJUSTING DEVICE

(75) Inventor: Nobuyuki Torisawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/100,000

(22) Filed: Mar. 19, 2002

(65) Prior Publication Data

US 2002/0135661 A1 Sep. 26, 2002

(30) Foreign Application Priority Data

Mar. 22, 2001 (JP) ..... P2001-083018

(51) Int. Cl.[7] ..... B41J 2/435
(52) U.S. Cl. ..... 347/228
(58) Field of Search ..... 347/133, 140, 347/212, 228, 155, 156; 399/328, 53; 430/328, 336, 350, 151; 266/87; 355/405, 27

(56) References Cited

U.S. PATENT DOCUMENTS 5,774,204 A * 6/1998 Suzuki et al. ..... 355/27
6,340,444 B1 * 1/2002 Hashiguchi ..... 266/97

FOREIGN PATENT DOCUMENTS

JP 55-55338 * 4/1980 ..... G03D/13/00
JP 8-6224 * 1/1996 ..... G03D/13/00

* cited by examiner

*Primary Examiner*—Hai Pham
(74) *Attorney, Agent, or Firm*—Sughrue Mion, PLLC

(57) ABSTRACT

A heat development apparatus (21) which heats a heat-developable sheet (A) having an exposure-development latent image formed therein while being conveyed therethrough so that the latent image is developed, characterized in that a heat development section (IV) includes a heating device (37) for heating the heat-developable sheet (A), a hold-down roller (38) disposed opposed to the heating device (37) for pressing the heat-developable sheet (A) against the heating device (37), and a temperature adjusting device (39) for raising the temperature of the hold-down roller (38) to a predetermined value.

5 Claims, 5 Drawing Sheets

HEAT DEVELOPMENT APPARATUS HAVING A TEMPERATURE ADJUSTING DEVICE

FIELD OF THE INVENTION

The present invention relates to a heat development apparatus which heats a heat-developable photosensitive material or photosensitive heat-sensitive recording material (heat-developable sheet) having an latent image by an exposure formed therein while being conveyed so that it is developed.

DESCRIPTION OF THE RELATED ART

In the art of plate-making image forming apparatus for making a printing plate or image forming apparatus for recording medical images such as CT (computed tomography) and MR (magnetic resonance), an image forming apparatus employing a dry system which performs wet process-free heat development to form an image has been noted. Such an image forming apparatus employs a photosensitive and/or heat-sensitive recording material (photosensitive heat-sensitive recording material) or a film made of heat-developable photosensitive material (hereinafter referred to as "heat-developable sheet"). In its exposure section, the heat-developable sheet is irradiated (scanned) with a laser beam to form a latent image therein. Thereafter, in its heat development section, the heat-developable sheet is brought into contact with a heating means to cause heat development thereof. Subsequently, the heat-developable sheet which has been heated in the heat development section is cooled to form an image thereon. The heat-developable sheet is then discharged out of the apparatus. Such a dry system image forming apparatus (hereinafter referred to as "heat development apparatus") can not only form an image in a short period of time as compared with the wet process but also eliminate the problem of disposal of waste liquid as seen in the wet process and thus can be much expected to be in growing demand in the future.

Such a heat development apparatus has heretofore employed a process which comprises pressing the heat-developable sheet against the heating means to facilitate development. In particular, a heat development system comprising a heating means made of heat plate and a plurality of hold-down rollers which are disposed opposed to each other between which the heat-developable sheet is conveyed is desirable because it is excellent in uniformity of heating and exhibits a strong resistance to contamination by dust or other foreign matters, making it possible to drastically eliminate uneven development, which is a problem of the conventional system.

Although in the foregoing conventional heat development apparatus, as the apparatus power supply is switched on to actuate the apparatus, the temperature of the heat plate gradually rises to a predetermined value, the hold-down roller which is disposed in contact with the heat plate to receive heat transmitted from the heat plate cannot reach the predetermined temperature at this point. When development is attempted under these circumstances, the heat of the heat plate for heating the heat-developable sheet is taken out by the hold-down roller through the heat-developable sheet, resulting in the heat development at a low temperature that can leave the heat-developable sheet undeveloped. Therefore, the heat development apparatus is forced to wait further until the hold-down roller is warmed to a predetermined temperature and thus is ready to start development. Thus, the heat development apparatus needs a prolonged rising time. For example, it takes from about 17 to 18 minutes for the heat plate to reach the predetermined temperature while it normally takes about 30 minutes for the hold-down roller to be warmed to the predetermined temperature and ready to start development.

In the conventional heat development apparatus, when continuous heat development is effected, heat transmitted from the heat plate is taken out or shielded by a continuous flow of the heat-developable sheets to lower the temperature of the hold-down roller. Therefore, the subsequent heat development of heat-developable sheet must be effected at a predetermined interval of time during which the temperature of the hold-down roller is restored, making it difficult to enhance the development capacity.

There has been proposed an approach involving the correction of exposure on the basis of estimation of drop of roller temperature. However, this approach is disadvantageous in that correction of exposure can be hardly made, resulting in unstable heat development.

SUMMARY OF THE INVENTION

The present invention has been worked out in the light of the foregoing circumstances. An object of the invention is to provide a heat development apparatus which can be actuated in a reduced rising time and perform continuous heat development of heat-developable sheet under a stabilized temperature gradient.

In order to accomplish the foregoing object of the invention, the heat development apparatus according to a first aspect of the invention is a heat development apparatus which heats a heat-developable sheet having a latent image formed therein by an exposure while being conveyed therethrough so that it is developed, comprising a heating means for heating the heat-developable sheet, a hold-down roller disposed opposed to the heating means for pressing the heat-developable sheet against the heating means; and a temperature adjusting means for raising the temperature of the hold-down roller to a predetermined value.

In this heat development apparatus, as the apparatus power supply is switched on, the hold-down roller is directly warmed by the temperature adjusting means. Accordingly, unlike the conventional arrangement in which the hold-down roller is indirectly warmed by heat conduction of the heating means, the temperature of the hold-down roller reaches a predetermined value that does not impede development at almost the same time as the heating means. As a result, the waiting period required until the hold-down roller is further warmed after the temperature of the heating means has reached a predetermined value as in the conventional case can be omitted, making it possible to reduce the rising time of the apparatus.

The heat development apparatus according to a second aspect of the invention is characterized in that the temperature adjusting means generates radiation heat to warm the hold-down roller.

In this heat development apparatus, the temperature adjusting means generates radiation heat to warm the hold-down roller, and the temperature of the hold-down roller thus warmed is controlled to have no effect on the development of the heat-developable sheet. In this manner, heat development cannot be conducted in an unstable manner. Thus, heat development can be always conducted in a stable manner.

The heat development apparatus according to a third aspect of the invention is characterized in that the temperature adjusting means warms the hold-down roller in such a manner that the temperature gradient between the heating means and the hold-down roller is kept constant.

The heat development apparatus is arranged such that the temperature of the hold-down roller which has been warmed is kept almost equal to or slightly lower than that of the heating means to keep the temperature gradient between the hold-down roller and the heating means constant. In this arrangement, continuous heat development process can be effected without having the heat of the heating means to be taken out by the hold-down roller through the heat-developable sheet. Accordingly, heat development can be effected in an invariably stable manner, making it possible to enhance the processing capacity.

The heat development apparatus according to a fourth aspect of the invention is characterized in that the hold-down roller comprises a temperature adjusting means incorporated integrally therewith.

In the foregoing heat development apparatus, the hold-down roller is of self-heating type comprising a heater provided in the interior of a hollow cylindrical core metal so that a temperature adjusting means is incorporated integrally therewith. In this arrangement, the space that would be required if the temperature adjusting means is disposed in the vicinity of the hold-down roller can be omitted to reduce the size of the apparatus. Further, since the various hold-down rollers can be separately temperature-controlled, uniform development conditions can be provided all over the length of the heat development section, e.g., by predetermining the temperature of the hold-down roller disposed at the inlet of the heat development section, where the temperature drop is highest due to the entrance of the heat-developable sheet, slightly higher than the standard value, predetermining the temperature of the hold-down roller disposed at the outlet of the heat development section, where the temperature drop is the lowest, slightly lower than the standard value, and forming a temperature gradient such that the temperature of the rollers gradually decreases from the inlet toward the outlet.

The heat development apparatus according to a fifth aspect of the invention is characterized in that the hold-down roller is temperature-controlled with a temperature sensor provided on the outer surface thereof.

In the foregoing heat development apparatus, the various hold-down rollers can be individually temperature-controlled with a temperature sensor to enable precision temperature control.

DESCRIPTION OF THE PREFERRED EMBODIMENTS

Preferred embodiments of the heat development apparatus according to the invention will be further described in connection with the attached drawings.

Figure 1:
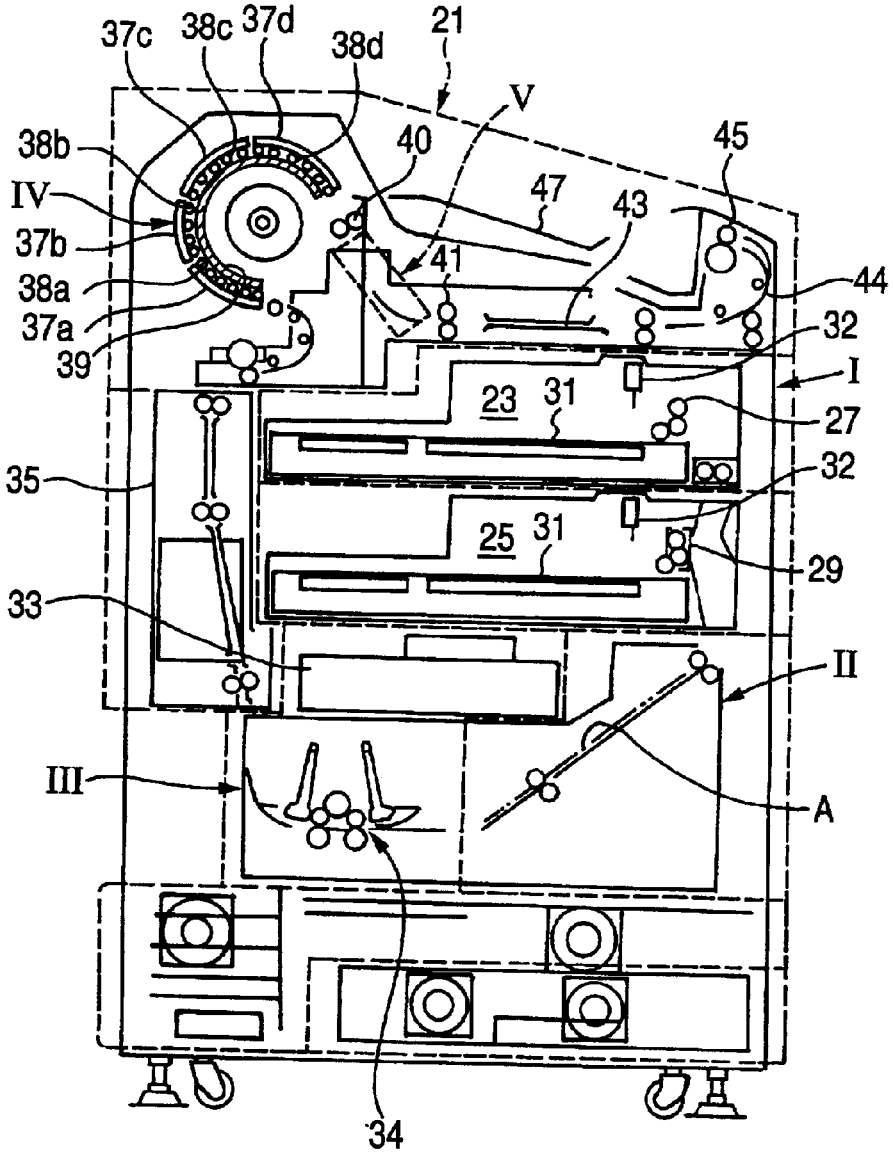
FIG. 1 is a schematic diagram illustrating an embodiment of the heat development apparatus according to the invention.
Figure 2:
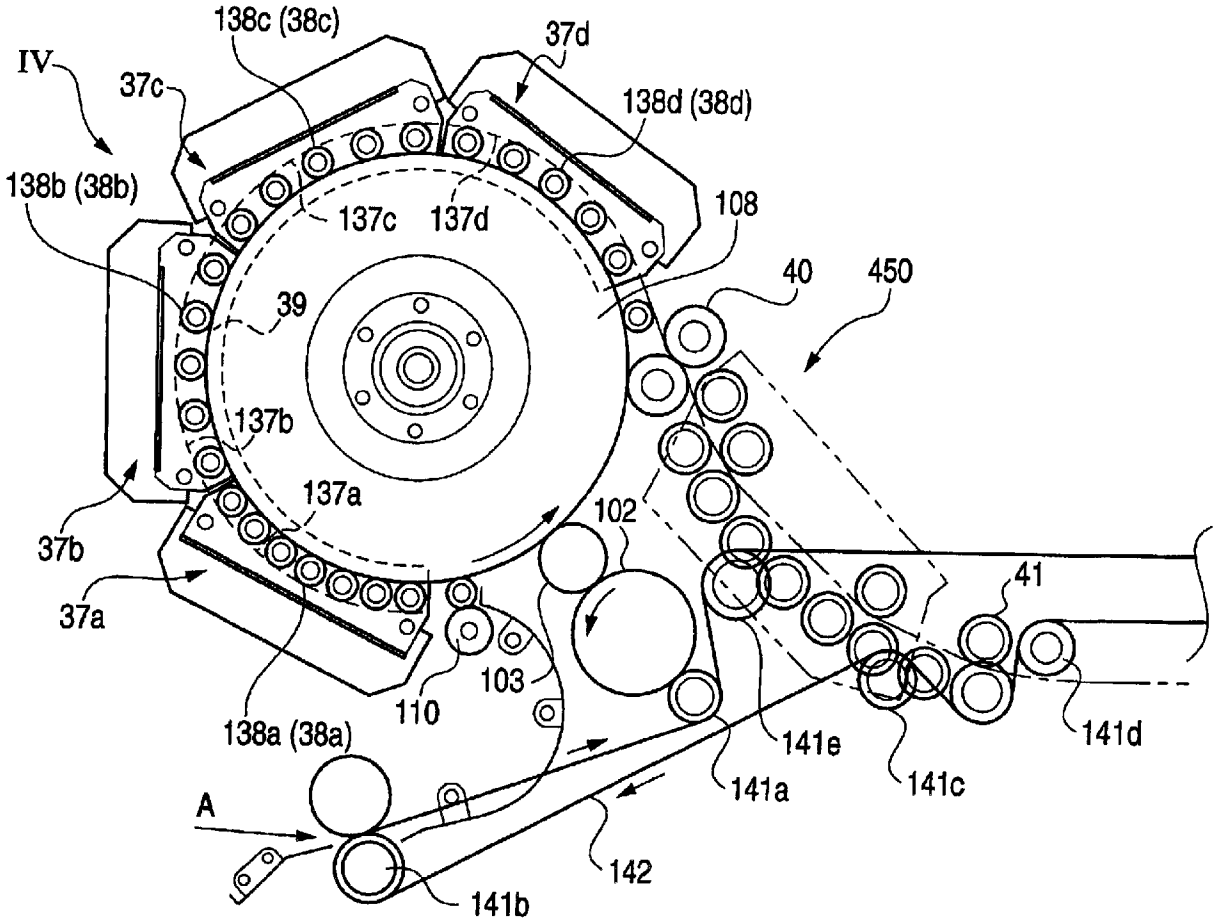
FIG. 2 is a diagram illustrating the internal structure of the heat development section shown in FIG. 1 and the conveying path provided therein.
Figure 3:
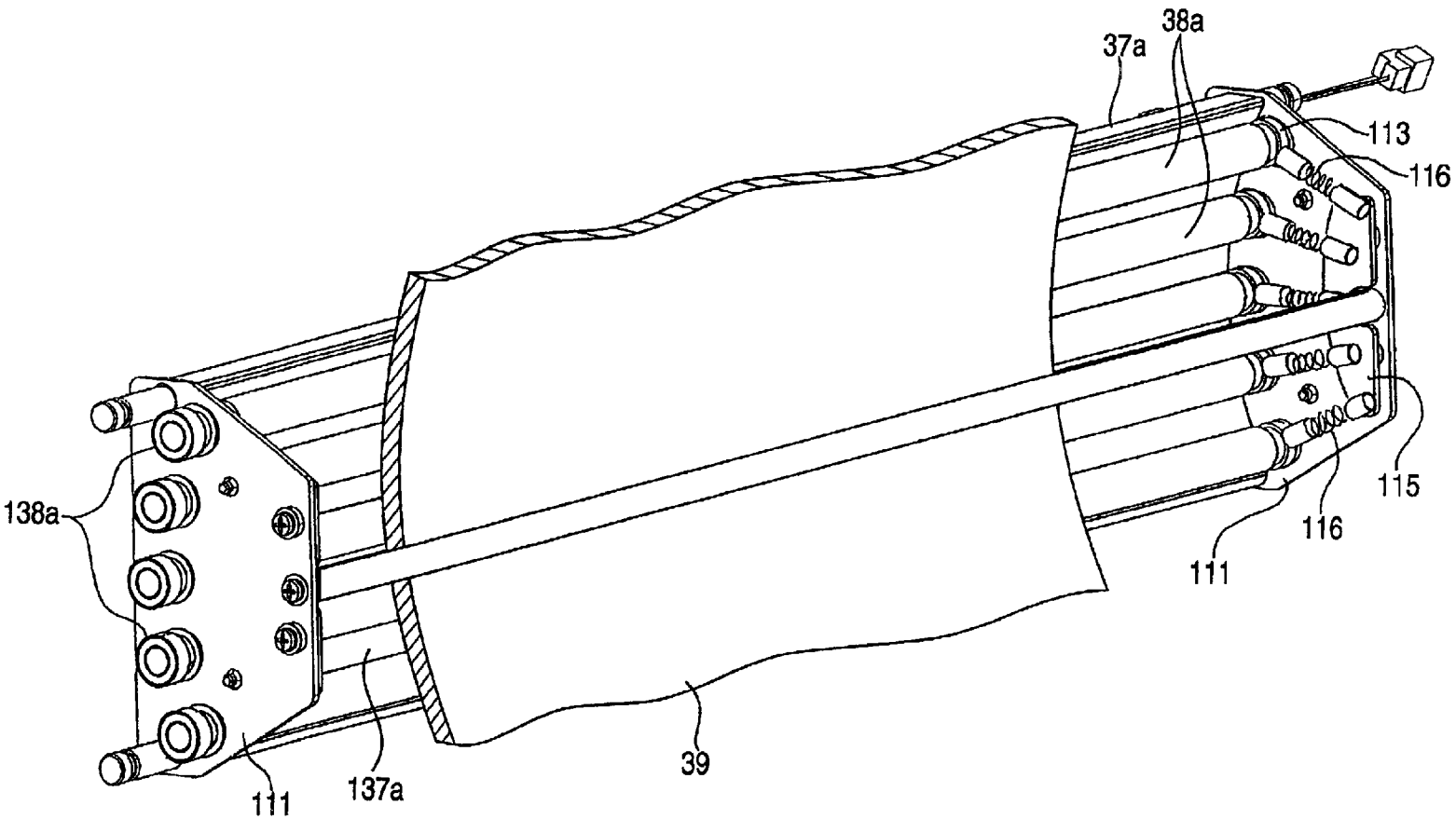
FIG. 3 is a perspective view illustrating the structure of one of heating units shown in FIG. 2.
Figure 4:
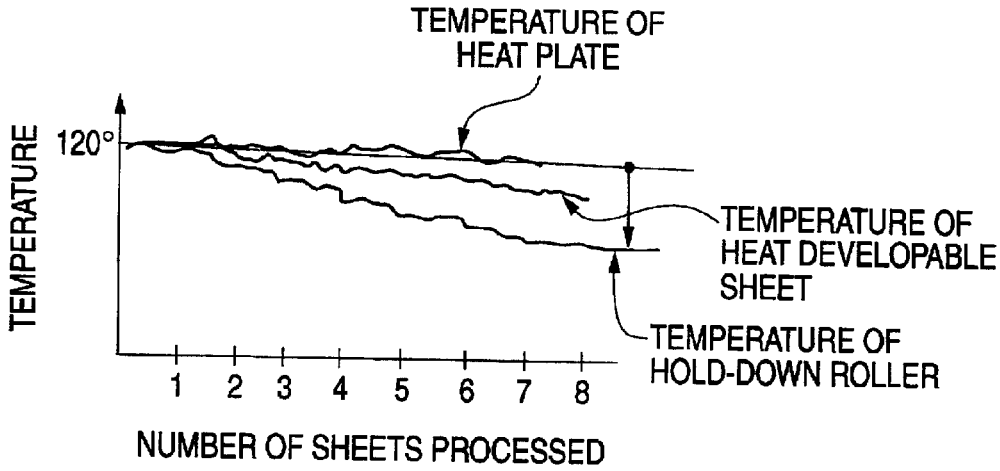
FIG. 4 is a temperature characteristic diagram illustrating the advantage of the invention.

FIG. 1 is a schematic diagram illustrating an embodiment of the heat development apparatus according to the invention. FIG. 2 is a diagram illustrating the internal structure of the heat development section shown in FIG. 1 and the conveying path provided therein. FIG. 3 is a perspective view illustrating the structure of one of heating units shown in FIG. 2. FIG. 4 is a temperature characteristic diagram illustrating the advantage of the invention.

As shown in FIG. 1, a heat development apparatus 21 comprises as main constituents a photosensitive material supply section I, a photosensitive material positioning section II, an imagewise exposure section III, a heat development section IV and a cooling section V provided in the order of conveyance of a heat-developable photosensitive material or photosensitive heat-sensitive recording material (heat-developable sheet) A.

The photosensitive material supply section I is a zone where heat-developable sheets A are picked up one sheet at a time and then supplied into the photosensitive material positioning section II, which is disposed downstream therefrom in the direction of conveyance of the heat-developable sheet A. The photosensitive material supply section I comprises two loading portions 23, 25, feed roller pairs 27, 29 provided in the loading portions 23, 25, respectively, and a conveying roller and a conveying guide (not shown).

Each of the loading portions 23 and 25 is a portion for disposing a magazine 31 receiving the heat-developable sheet A in a predetermined position. In the embodiment shown, there are two loading portions 23, 25 which form a two-stage structure. The loading portions 23, 25 are loaded with magazines 31 receiving heat-developable sheets A having different sizes (e.g., B4 size, 14"×17" (35 cm×43 cm) size), respectively. The loading portions 23, 25 are each provided with a photosensitive material supply means 32 which uses a sucker to adsorb and retain the heat-developable sheet A. The sucker is then moved by a known moving means such as link mechanism to convey and supply the heat-developable sheet A onto feed roller pairs 27, 29 provided in the loading portions 23, 25, respectively.

The heat-developable sheet A may be a heat-developable photosensitive material or photosensitive heat-sensitive recording material as previously mentioned. The heat-developable sheet A, if it is a heat-developable photosensitive material, is subjected to image recording by at least one light beam such as laser beam (imagewise exposure), and then subjected to heat development to undergo color development.

Alternatively, the heat-developable sheet A, if it is a photosensitive heat-sensitive material, is subjected to image recording by at least one light beam such as laser beam (imagewise exposure), and then subjected to heat development to undergo color development.

The heat-developable sheet A is in the form of sheet. In general, a predetermined number (e.g., 100) sheets of the heat-developable sheet A are stacked (bundled) and wrapped with a bag or band to give a package.

The heat-developable sheet A which has been supplied onto the feed roller pair 27 or 29 is conveyed to the respective photosensitive material positioning section II disposed downstream by the conveying rollers while being guided by the conveying guide.

The photosensitive material positioning section II positions the heat-developable sheet A in the direction perpendicular to the conveying direction (crosswise direction) to position the heat-developable sheet A in the main scanning direction in the imagewise exposure section III disposed downstream.

The imagewise exposure section III is a portion for scanning the heat-developable sheet A with light beam to imagewise expose the heat-developable sheet A. The imagewise exposure section III comprises an optical unit 33 and a subsidiary scanning/conveying means 34.

The optical unit 33 is a known light beam scanning apparatus for deflecting light beam modulated according to recorded image in the main scanning direction (crosswise direction of the heat-developable sheet A) to irradiate the light beam onto the predetermined recording position. The optical unit 33 is further provided with various members to be provided in a known light beam scanning apparatus such as collimator lens or beam expander for reforming the light beam emitted by the light source, optical face tangle error correction system and optical path adjusting mirror as necessary. Since the light beam which has been pulse width-modulated according to the recorded image is deflected in the direction of main scanning, the heat-developable sheet A which is being conveyed in the direction of subsidiary scanning is two-dimensionally scanned for exposure to have a latent image formed therein.

The heat-developable sheet A which has had a latent image formed therein at the imagewise exposure section III is then conveyed to the heat development section IV through a transferring zone 35. The heat development section IV is formed by bending a heat plate 37 divided into four parts (37*a*, 37*b*, 37*c*, 37*d*). These heat plates 37 and hold-down rollers 38 (38*a*, 38*b*, 38*c*, 38*d*) formed by a plurality of rollers which are rotatably arranged are continuously arranged in an arc. The heat plate 37 is a heating means defined herein for heating and developing the heat-developable sheet A.

Provided inside the hold-down rollers 38 is a temperature adjusting means 39 which raises the temperature of the atmosphere in the vicinity of the hold-down rollers 38 to generate radiation heat that warms the hold-down rollers 38 while preventing the hold-down rollers 38 thus warmed from varying in temperature to keep the hold-down rollers 38 at a predetermined temperature.

Referring further to the heat development section IV, the heat development section IV comprises concaves 137*a*, 137*b*, 137*c* and 137*d* formed by bending the heat plate 37, and hold-down rollers 38 formed by a plurality of roller blocks are disposed opposed to the concaves 137*a*, 137*b*, 137*c* and 137*d* as shown in FIG. 2.

The hold-down rollers 38 are provided with driven gears 138*a*, 138*b*, 138*c* and 138*d* at the axial ends thereof. A driving gear 108 is provided to rotate on the center of the arc along which the hold-down rollers 38 are arranged in such an arrangement that it engages with the driven gears 138*a*, 138*b*, 138*c* and 138*d*.

The driving gear 108 is rotationally driven via an intermediate gear 103 by a main gear 102 which is driven by a motor. A feed roller pair 110 is provided at the inlet of the heat development section IV to convey the heat-developable sheet A into the heat development section IV.

The main gear 102 is arranged to rotationally drive the driven gear 108 as well as the feed roller pair 110.

When the main gear 102 thus drives rotationally the driven gear 108 and the feed roller pair 110, the various hold-down rollers 38*a*, 38*b*, 38*c* and 38*d* rotate to move the heat-developable sheet A while bringing the heat-developable sheet A into the concaves 137*a*, 137*b*, 137*c* and 137*d* of the heat plate 37 successively. In this manner, in the heat development section IV, the heat-developable sheet A can be smoothly conveyed while being pressed against the heat plate 37 at the forward end thereof to prevent the buckling thereof so that it is fairly heat-developed.

FIG. 3 illustrates one heating unit comprising the heat plate 37*a*, which is one of the four heat plates, and the hold-down roller 38*a* formed by a plurality of roller blocks.

The heat plate 37*a* and the hold-down rollers 38*a* are retained between a pair of side plates 111. The driven gear 138*a* provided at an axial end of the hold-down roller 38*a* is positioned outside the side plate 111. The hold-down roller 38*a* is rotatably supported by the bearing 113. The bearing 113 is energized toward the concave of the heat plate 37*a* by the energizing force of an energizing member 116 supported on the side plate 111 with a retaining member 115. In this arrangement, the hold-down roller 38*a* makes pressure contact with the concave 137*a* of the heat plate 37*a*.

The hold-down roller 38 is made of silicone to accomplish both desired sheet conveying properties and releasability.

Inside and close to the hold-down roller 38*a* is provided a temperature adjusting means 39 which is one of requirements characteristic to the present embodiment.

The temperature adjusting means 39 is a plate-like silicone rubber heater which is supported on the side plate 111 with a fixing means (not shown) and extends all over the axial range of the hold-down roller 38*a*. However, the temperature adjusting means 39 may be provided on a part of the area of the hold-down roller 38*a* so that the hold-down roller 38*a* can be warmed depending on the thermal conductivity of the hold-down roller 38*a*.

As previously mentioned, the temperature adjusting means 39 is electrically energized in synchronism with the heating of the heat plate 37*a* caused by switching on of the apparatus power supply. The energization of the temperature adjusting means 39 is accompanied by the rise of the ambient temperature that causes the generation of radiation heat which then warms the hold-down roller 38*a* to a predetermined temperature. Once the temperature of the hold-down roller 38*a* has reached the predetermined temperature, the temperature adjusting means 39 warms the hold-down roller 38*a* the temperature of which has been lowered due to continuous heat development in such a manner that the temperature gradient between the hold-down roller 38*a* and the heat plate 37*a* is invariably kept constant. The temperature adjusting means 39 may be a plate-like ceramic heater.

Referring again to FIGS. 1 and 2, a cooling section V is provided downstream the heat development section IV.

The heat-developable sheet A which has been discharged from the heat development section IV by a discharge roller pair 40 is then passed through the cooling section V so that it is cooled to a temperature lower than the heat development processing temperature. The heat-developable sheet A is guided to guide plates 43, 44 by a conveying roller pair 41, and then distributed into a tray through a discharge roller pair 45.

The conveying roller pair 41 is driven by the driving force of the main gear 102 which has been transmitted through a plurality of power transmission gears 141*a*, 141*b*, 141*c*, 141*d* and 141*e* and a driving belt 142.

As mentioned above, the heat development apparatus 21 of the present embodiment is provided with the temperature adjusting means 39 in such an arrangement that the hold-down roller 38 is warmed by radiation heat thus generated. In this arrangement, the temperature of the hold-down roller 38 can be raised to a predetermined value at almost the same time as the temperature of the heat plate 37 reaches a predetermined value due to switching on of the apparatus power supply. As a result, the heat development apparatus 21 immediately can perform heat development, making it possible to reduce the waiting period during which the apparatus is actuated.

The temperature of the hold-down roller 38 is equal to the predetermined temperature of the heat plate 37, i.e., equal to or slightly lower than the heat development processing temperature of the heat-developable sheet (e.g., 120° C. or from 115° C. to 119° C.).

As shown in FIG. 4, the heat development apparatus 21 is arranged such that the temperature adjusting means 39 warms the hold-down roller 38 in such a manner that the temperature gradient between the hold-down roller 38 and the heat plate 37 can be invariably kept constant to prevent the increase of temperature drop of the hold-down roller 38 that causes the development processing heat of the heat plate 37 to be caught by the hold-down roller 38. In this arrangement, continuous heat development can be effected. Further, even when the processing speed is raised, invariably stable heat development can be effected to enhance the development capacity.

In other words, the temperature adjusting means 39 can generate radiation heat to warm the hold-down roller 38, making it possible to reduce the rising time of the apparatus without giving any effect on the development processing temperature of the heat-developable sheet A. At the same time, the temperature adjusting means 39 prevents the variation of temperature of the hold-down roller 38 to enable continuous heat development of the heat-developable sheet.

Figure 5:
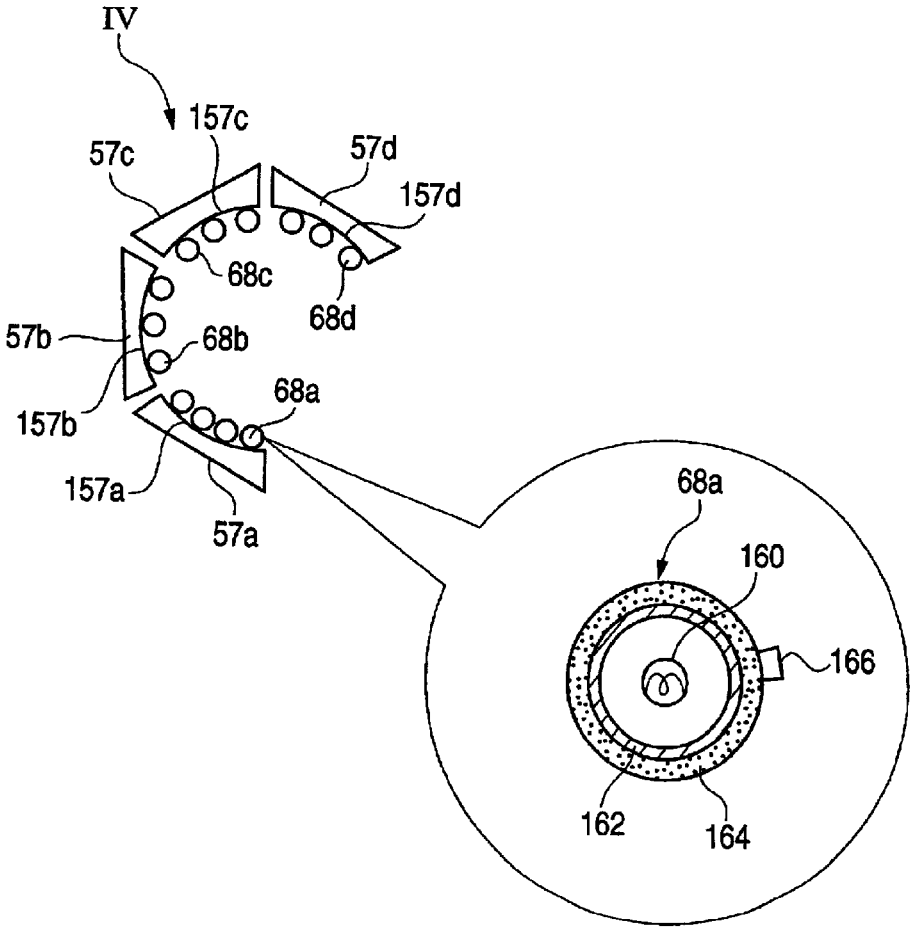
FIG. 5 is a schematic diagram illustrating the heat development section in another embodiment of implication of the present invention.

FIG. 5 illustrates the heat development section in a further embodiment of implication of the present invention. All the zones and portions of this embodiment have the same structure as those of the preceding embodiments except this heat development section.

The constitution of the heat development section IV of this embodiment is the same as the preceding embodiments in that four heat plates 57 (57*a*, 57*b*, 57*c*, 57*d*) have concaves 157*a*, 157*b*, 157*c* and 157*d*, respectively, and hold-down rollers 68 (68*a*, 68*b*, 68*c*, 68*d*) comprising a plurality of roller blocks are disposed opposed to the concaves 157*a*, 157*b*, 157*c* and 157*d*, respectively.

In this embodiment, however, the various hold-down rollers 68 each are a heat roller comprising a core metal 162 made of aluminum, a rubber coat layer 164 made of, e.g., silicone rubber having an excellent releasability with respect to the heat-developable sheet, and an infrared lamp 160 integrally incorporated as a heat source in the interior of the core metal 162 as shown in an enlarged view. In other words, the infrared lamp 160 forms a temperature adjusting means. The hold-down roller 68 is warmed by the infrared lamp 160 such that the temperature of the surface thereof reaches a predetermined value. To this end, a temperature sensor 166 such as thermistor for detecting the surface temperature is provided on the surface of the various hold-down rollers 68. The core metal 162 may be made of a non-metallic material such as ceramic instead of metal such as aluminum.

In accordance with the heat development apparatus provided with such a heat development section IV, the space required to dispose the temperature adjusting means close to the hold-down roller can be omitted, making it possible to reduce the size of the apparatus to advantage.

Further, since the various hold-down rollers are each provided with the temperature sensor 166, precision temperature control can be conducted. In particular, even in the case where the surface heat of the hold-down roller 68 is caught by the heat-developable sheet due to continuous heat development, since the hold-down roller 68*a* of the heating unit disposed at the inlet of the heat development section IV and the hold-down roller 68*d* of the heating unit disposed at the outlet of the heat development section IV differ from each other in temperature drop, the temperature of the hold-down rollers can be kept uniform all over the entire heat development section IV by predetermining the temperature gradient of the hold-down rollers 68*a*, 68*b*, 68*c* and 68*d* depending on the different temperature drop. In this arrangement, continuous heat development of the heat-developable sheet can be effected in an invariably stable manner.

Figure 6:
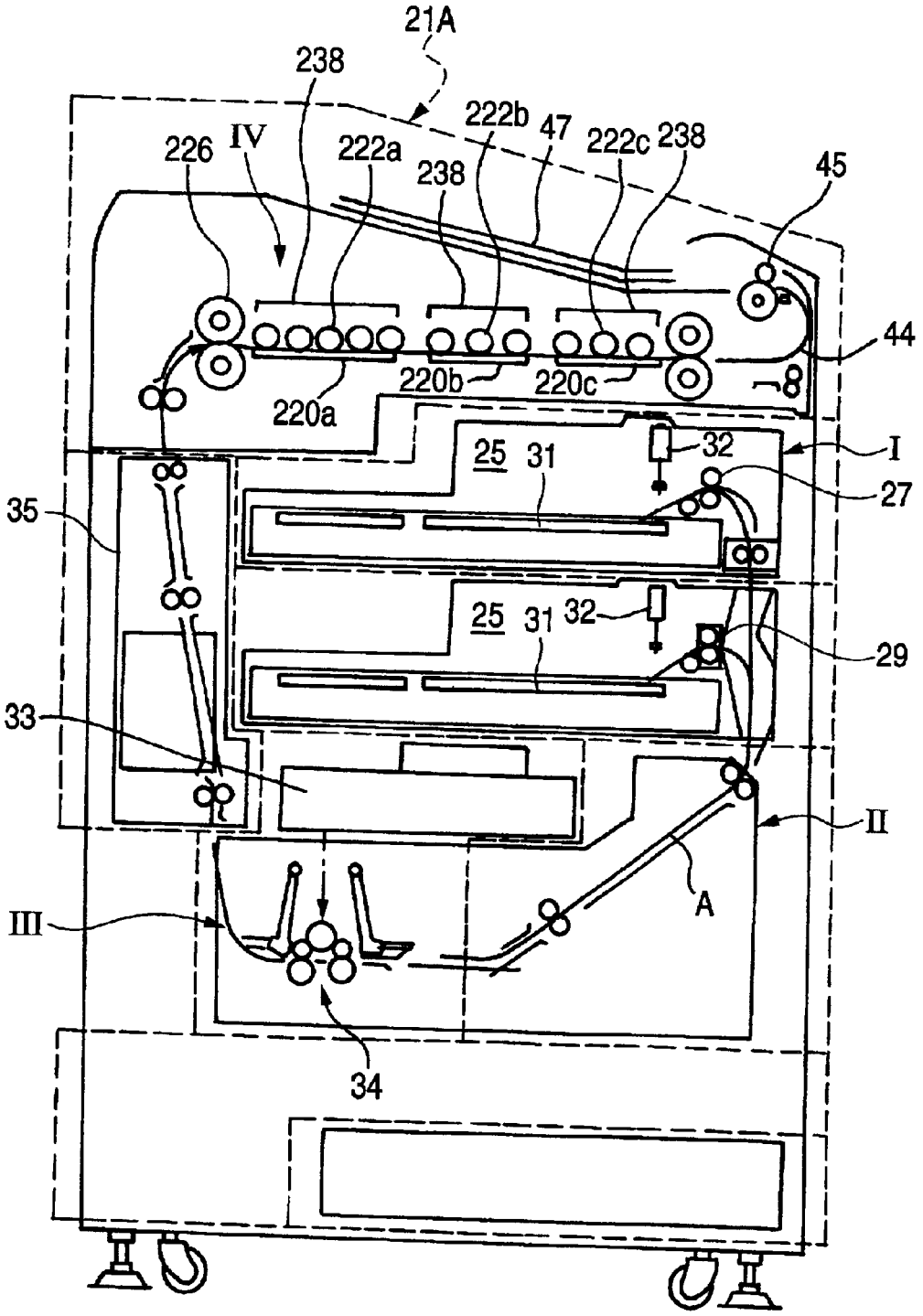
FIG. 6 is a schematic diagram illustrating a further embodiment of the heat development apparatus according to the invention.

FIG. 6 is a schematic diagram illustrating a further embodiment of the heat development apparatus according to the invention.

In this embodiment, the heat development section comprises heat plates and hold-down rollers linearly arranged along the conveying path of sheet. All the zones and portions of this embodiment have the same structure as those of the preceding embodiments except this heat development section. Therefore, these similar zones and portions are given similar reference numerals, but their description will be omitted.

The heat development apparatus 21A according to this embodiment comprises as main constituents a photosensitive material supply section I, a photosensitive material positioning section II, an imagewise exposure section III, and a heat development section IV provided in the order of conveyance of a heat-developable photosensitive material or photosensitive heat-sensitive recording material (heat-developable sheet) A.

The heat development section IV comprises three planar heat plates 220 (220*a*, 220*b*, 220*c*) linearly arranged along the conveying path of the heat-developable sheet A as heating means for heat-developing the heat-developable sheet A, a sheet moving means 226 for making relative movement (sliding movement) of the heat-developable sheet A in contact with the heat plates 220, hold-down rollers 222 (222*a*, 222*b*, 222*c*) for pressing the heat-developable sheet A against the heat plates 220 to allow heat to be transmitted from the heat plates 220 to the heat-developable sheet A, and a rubber heater which is disposed close to the back side of the hold-down rollers 222 to form a temperature adjusting means 238 for warming the hold-down rollers 222.

The temperature adjusting means 238 generates radiation heat close to the hold-down rollers 222 to warm the hold-down rollers 222*a*, 222*b* and 222*c* to a predetermined temperature.

The various heat plates 220*a*, 220*b* and 220*c* are each provided thereinside with a plate-like heating member having at least one heating element (e.g., nichrome wire) laid flatly therein so that they are kept at the development processing temperature of the heat-developable sheet A.

The heat development apparatus 21A is arranged such that the heat-developable sheet A which has been heat-developed and discharged from the heat development section IV is guided to a guide plate 44 by which it is then discharged from a discharge roller pair 45 into a tray 47.

In this arrangement, the temperature adjusting means 238 warms the hold-down rollers 222, making it possible to drastically reduce the waiting period during which the apparatus is actuated as compared with the arrangement such that the hold-down rollers are warmed by heat transmitted after the heating of the heat plates to the predetermined temperature as in the conventional apparatus.

Further, even when continuous heat development is effected, the heat of the heat plates 220 cannot be caught by the hold-down rollers 222 through the heat-developable sheet A, making it possible to enhance the development capacity.

Moreover, the arrangement enabling linear movement of heat-developable sheet simplifies the sheet conveying mechanism, making it possible to reduce the production cost of apparatus.

As mentioned in detail above, in accordance with the heat development apparatus according to the invention, a hold-down roller which presses the heat-developable sheet against the heating means to effect heat development is warmed by a temperature adjusting means separately provided instead of by heat transmitted from the heating means, making it possible to cause the temperature of the hold-down roller to reach the predetermined value at almost the same time as the temperature of the heating means reaches the predetermined value at the rising of the apparatus. In this arrangement, the rising time of apparatus can be drastically reduced from that of the conventional apparatus.

Further, the temperature adjusting means warms the hold-down rollers in such a manner that the temperature gradient between the heating means and the hold-down rollers is invariably kept constant, making it possible to eliminate the temperature drop of the hold-down rollers due to continuous heat development of heat-developable sheet and hence perform continuous processing in a stable manner.

What is claimed is:

1. A heat development apparatus which heats a heat-developable sheet having a latent image formed by an exposure therein while being conveyed therethrough so that said latent image is developed, comprising:

a heating means for heating said heat-developable sheet;

a plurality of hold-down rollers disposed opposed to said heating means for pressing said heat-developable sheet against said heating means; and temperature adjusting means for raising the temperature of said hold-down rollers to a predetermined value, wherein said temperature adjusting means is disposed at an interior portion of each of said hold-down rollers.

2. The heat development apparatus according to claim 1, wherein said temperature adjusting means generates radiation heat to warm said hold-down roller.

3. The heat development apparatus according to claim 1, wherein said hold-down roller is warmed in such a manner that the temperature gradient between said heating means and said hold-down roller is kept constant.

4. The heat development apparatus according to claim 1, wherein said hold-down roller comprises said temperature adjusting means incorporated integrally therewith.

5. The heat development apparatus according to claim 4, wherein said hold-down roller is temperature-controlled with a temperature sensor provided on the outer surface thereof.

* * * * *